US012364303B2

(12) United States Patent
Langlois et al.

(10) Patent No.: US 12,364,303 B2
(45) Date of Patent: Jul. 22, 2025

(54) VISOR ASSEMBLY FOR SPORTS HELMET

(71) Applicant: SPORT MASKA INC., Montreal (CA)

(72) Inventors: Simon Langlois, Notre-Dame-de-l'Île-Perrot (CA); Pierre-Luc Beauchamp, Montréal (CA); Brian Steenbrink, Pointe-Claire (CA)

(73) Assignee: SPORT MASKA INC.

( * ) Notice: Subject to any disclaimer, the term of this patent is extended or adjusted under 35 U.S.C. 154(b) by 0 days.

(21) Appl. No.: 18/023,816

(22) PCT Filed: Sep. 15, 2021

(86) PCT No.: PCT/CA2021/051288
§ 371 (c)(1),
(2) Date: Feb. 28, 2023

(87) PCT Pub. No.: WO2022/094692
PCT Pub. Date: May 12, 2022

(65) Prior Publication Data

US 2023/0309643 A1 Oct. 5, 2023

Related U.S. Application Data

(60) Provisional application No. 63/078,608, filed on Sep. 15, 2020.

(51) Int. Cl.
*A42B 3/22* (2006.01)

(52) U.S. Cl.
CPC ..... *A42B 3/221* (2013.01)

(58) Field of Classification Search
CPC ..... A42B 3/221
See application file for complete search history.

(56) References Cited

U.S. PATENT DOCUMENTS 2,709,470 A * 5/1955 Knohl ..... F16B 39/24 411/959
3,263,236 A * 8/1966 Humphrey ..... A42B 3/20 2/9

(Continued)

FOREIGN PATENT DOCUMENTS

CA 2938844 2/2017

OTHER PUBLICATIONS

"Visor." Merriam Webster. Jan. 31, 2025. (Year: 2025).*

*Primary Examiner* — Grace Huang
(74) *Attorney, Agent, or Firm* — NORTON ROSE FULBRIGHT CANADA

(57) ABSTRACT

A visor has: a visor body defining a visor aperture through the visor body on a side of the visor body; and an attachment device on the side of the visor body to secure the visor to a corresponding one of the flaps of the outer shell of the sport helmet, the attachment device having: a fastener extending through the visor aperture, the fastener having a head facing an outer side of the visor body, the fastener defining first threads threadingly engaged to second threads defined by one or both of the corresponding one of the flaps and a nut secured to the outer shell, and a spacer facing an inner side of the visor body, the spacer defining a spacer aperture in register with the visor aperture, the fastener extending in the spacer aperture at least partially through the spacer.

13 Claims, 10 Drawing Sheets

(56) References Cited

U.S. PATENT DOCUMENTS 3,274,613 A * 9/1966 Sowle ..... A42B 3/20 2/9
4,021,858 A * 5/1977 Neeld ..... A42B 3/08 2/9
4,689,836 A * 9/1987 Vitaloni ..... A42B 3/222 2/9
4,692,947 A * 9/1987 Black ..... A42B 3/08 2/9
4,885,806 A * 12/1989 Heller ..... A42B 3/326 2/424
5,095,552 A * 3/1992 Parkinson ..... A42B 3/20 2/9
5,177,816 A * 1/1993 Schmidt ..... A42B 3/221 2/909
5,570,982 A * 11/1996 Lautenschlager ..... F16B 41/002 411/355
5,978,973 A * 11/1999 Chartrand ..... A42B 3/20 2/424
6,490,729 B1 * 12/2002 Dondero ..... A61F 9/02 2/10
6,934,971 B2 * 8/2005 Ide ..... A42B 3/08 2/9
8,899,867 B2 * 12/2014 Tatomir ..... A42B 3/04 403/168
9,004,801 B2 * 4/2015 Tatomir ..... A42B 3/20 2/424
11,266,197 B2 * 3/2022 Tatomir ..... A42B 3/221
2008/0250550 A1 * 10/2008 Bologna ..... A63B 71/10 2/425
2010/0083413 A1 * 4/2010 Mcgovern ..... A42B 3/04 2/6.6
2011/0214224 A1 * 9/2011 Maddux ..... A42B 3/20 2/424
2013/0036533 A1 * 2/2013 Gentry ..... A42B 3/18 2/422
2021/0093036 A1 * 4/2021 Durocher ..... A42B 3/20
2023/0009694 A1 * 1/2023 Labrosse-Girard ..... A42B 3/22

* cited by examiner

VISOR ASSEMBLY FOR SPORTS HELMET

CROSS-REFERENCE TO RELATED APPLICATIONS

This application is a United States Patent Application filed under 35 U.S.C. 371 of International Patent Application No. PCT/CA2021/051288 filed Sep. 15, 2021, which claims priority from U.S. Patent Application No. 63/078,608 filed on Sep. 15, 2020, the entire contents of both of which are incorporated herein by reference.

TECHNICAL FIELD

The disclosure relates generally to face shields for protective headgear, to protective headgear having such face shields, and to mounting assemblies for removably attaching a protective face shield to a headgear.

BACKGROUND

Participants in certain sporting activities, such as ice hockey, wear protective headgear or helmets to help prevent head injuries. The headgear may include a face protector that attaches to a helmet to provide additional protection for the player's face and eyes. By way of example, ice hockey players regularly wear a protective helmet with a face shield, which protects all of a player's face, or a visor, which protects part of a player's face, to protect from possible injuries that may be caused by other players, a puck, and sticks.

Visors are typically attached to the side of a helmet via fasteners, such as screws, and nuts. Each of the screw/nut combination passes through a suitably shaped hole defined through a shell of the sports helmet. There is however a need to provide a space between the visor and the shell of the helmet, typically at locations where the visor is secured to the shell. A spacer between the visor and the shell of the helmet may therefore be added to the screw/nut combination. However, the addition of the spacer means that an additional item is required to attach the face protection to the helmet, which not only makes it more difficult for a wearer to secure the face protector to the helmet, but also increases the risk of incorrectly assembling all of the pieces together.

BRIEF SUMMARY

In one aspect, there is provided a visor securable to a sport helmet, the sport helmet having an outer shell defining flaps covering temples of head of a wearer, the visor comprising: a visor body defining a visor aperture through the visor body on a side of the visor body; and an attachment device on the side of the visor body to secure the visor to a corresponding one of the flaps of the outer shell of the sport helmet, the attachment device having: a fastener extending through the visor aperture, the fastener having a head facing an outer side of the visor body, the fastener defining first threads threadingly engaged to second threads defined by one or both of the corresponding one of the flaps and a nut secured to the outer shell, and a spacer facing an inner side of the visor body, the spacer defining a spacer aperture in register with the visor aperture, the fastener extending in the spacer aperture at least partially through the spacer.

The visor may include any of the following features, in any combinations.

In some embodiments, the spacer includes a first face for facing the outer shell and a second face oriented toward the visor, the spacer aperture extending from the first face to the second face, the spacer aperture having a first section extending from the first face toward the second face and a second section extending from the first section to the second face, a diameter of the first section greater than a diameter of the second section.

In some embodiments, the diameter of the second section is less than a diameter of the first threads of the fastener.

In some embodiments, the spacer defines an opening extending from a peripheral face of the spacer to the spacer aperture.

In some embodiments, a width of the opening is less than a diameter of a shank of the fastener.

In some embodiments, the spacer is made of an elastomeric material.

In some embodiments, the nut has a base abuttable against an inner side of the outer shell and a post protruding from the base, the post defining the second threads threadingly engaged by the first threads of the fastener, the post sized to be received within a flap aperture defined by the corresponding one of the flaps.

In some embodiments, an inner surface of the post defines a proximal section extending from the base and a distal section extending from the proximal section to a distal end of the post, the second threads defined by the proximal section.

In some embodiments, the distal section is free of the second threads.

In some embodiments, the post includes two posts each protruding from the base and wherein the fastener includes two fasteners, each of the two posts defining second threads matingly engageable to first threads of the two fasteners.

In some embodiments, an outer diameter of the first threads of the fastener is less than an inner diameter of the distal section of the post such that the fastener is slidably receivable within the distal section of the post.

In some embodiments, a washer is located between the head of the fastener and the visor, the washer being beveled and/or serrated on one or both of its opposed faces.

In another aspect, there is provided an attachment device for securing a visor body to an outer shell of a sport helmet, the visor body defining a visor aperture, the attachment device comprising: a fastener sized to extend through the visor aperture, the fastener having a head for facing an outer side of the visor body, the fastener defining first threads threadingly engaged to second threads defined by one or both of a flap of the outer shell of the helmet and a nut secured to the outer shell, and a spacer for facing an inner side of the visor body and sized to be received between the visor body and the flap, the spacer defining a spacer aperture, the fastener extending in the spacer aperture at least partially through the spacer.

The attachment device may include any of the following features, in any combinations.

In some embodiments, the spacer includes a first face for facing the outer shell and a second face oriented toward the visor body, the spacer aperture extending from the first face to the second face, the spacer aperture having a first section extending from the first face toward the second face and a second section extending from the first section to the second face, a diameter of the first section greater than a diameter of the second section.

In some embodiments, the diameter of the second section is less than a diameter of the first threads of the fastener.

In some embodiments, the spacer defines an opening extending from a peripheral face of the spacer to the spacer aperture.

In some embodiments, a width of the opening is less than a diameter of a shank of the fastener.

In some embodiments, the spacer is made of an elastomeric material.

In some embodiments, the nut has a base abuttable against an inner side of the outer shell and a post protruding from the base, the post defining the second threads threadingly engaged by the first threads of the fastener, the post sized to be received within a flap aperture defined by the flap.

In some embodiments, an inner surface of the post defines a proximal section extending from the base and a distal section extending from the proximal section to a distal end of the post, the second threads defined by the proximal section.

In some embodiments, the distal section is free of the second threads.

In some embodiments, the post includes two posts each protruding from the base and wherein the fastener includes two fasteners, each of the two posts defining second threads matingly engageable to first threads of the two fasteners.

In some embodiments, an outer diameter of the first threads of the fastener is less than an inner diameter of the distal section of the inner surface of the post such that the fastener is slidably receivable within the distal section of the post.

In some embodiments, a washer is located between the head of the fastener and the visor body, the washer being beveled and/or serrated on one or both of its opposed faces.

In yet another aspect, there is provided a method of installing a visor to a helmet, the helmet having an outer shell including a flap defining a flap aperture therethrough, the method comprising: obtaining the visor having a visor body and an attachment device including a fastener and a spacer, the spacer defining a spacer aperture receiving the fastener; disposing the spacer to face an outer side of the outer shell and aligning the spacer aperture with the flap aperture; and inserting the fastener through the visor aperture and in the spacer aperture at least partially through the spacer until first threads of the fastener are threadingly engaged to second threads defined by one or both of the flap aperture and a nut secured to the outer shell.

The method may include any of the following features, in any combinations.

In some embodiments, the spacer aperture has a first section and a second section of a greater diameter than the first section, the method comprising inserting the fastener through the visor aperture and through the first section of the spacer aperture until the first threads of the fastener are received within the second section of the spacer aperture.

In some embodiments, the second threads are defined by the nut, the nut having a base and a post protruding from the base, the method comprising inserting the post through a flap aperture defined by the flap until the base is abutted against an inner side of the outer shell.

In some embodiments, an inner surface of the post defines a proximal section extending from the base and a distal section extending from the proximal section to a distal end of the post, the second threads defined by the proximal section, the method comprising slidingly inserting the first threads of the fastener into the distal section of the post until the first threads reaches the second threads and threadingly engaging the first threads to the second threads.

In some embodiments, the inserting of the post through the flap aperture includes inserting the post through the flap aperture until the post protrudes beyond the outer side of the outer shell.

In some embodiments, the method comprises inserting a portion of the post that protrudes beyond the outer shell partially through the spacer aperture.

DETAILED DESCRIPTION

Anatomy

Figure 1:
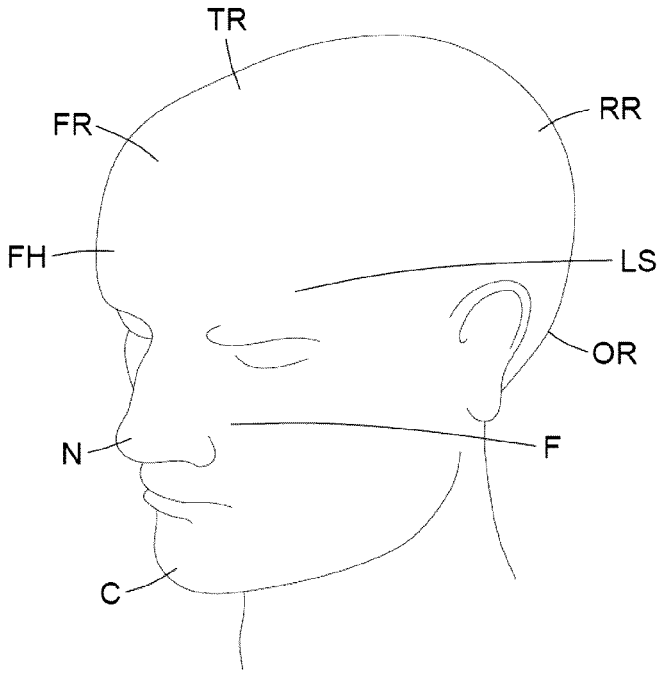
FIG. 1 is a schematic three dimensional view of a head of a wearer.
Figure 2:
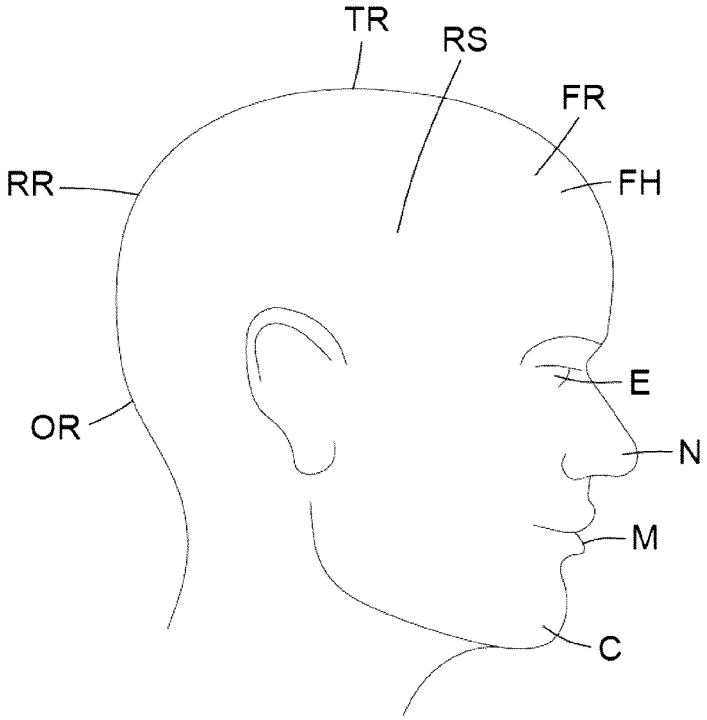
FIG. 2 is a schematic side view of the head of the wearer of FIG. 1.

FIGS. 1 and 2 show a wearer's head comprising a front region FR, right and left side regions RS, LS, a rear region RR, and a top region TR. The front region FR includes a face F of the wearer, eyes E, a nose N and a mouth M of the wearer's face F, a chin C, and a forehead FH. The right and left side regions RS, LS are located between the front region FR and the rear region RR of the head and include right and left temples and ears and right and left lateral parts of the head in right and left temporal bone areas of the head. The rear region RR has a rear upper part and an occipital region OR comprising an occipital protuberance in a parietal bone area and occipital bone area.

Helmet

Figure 3:
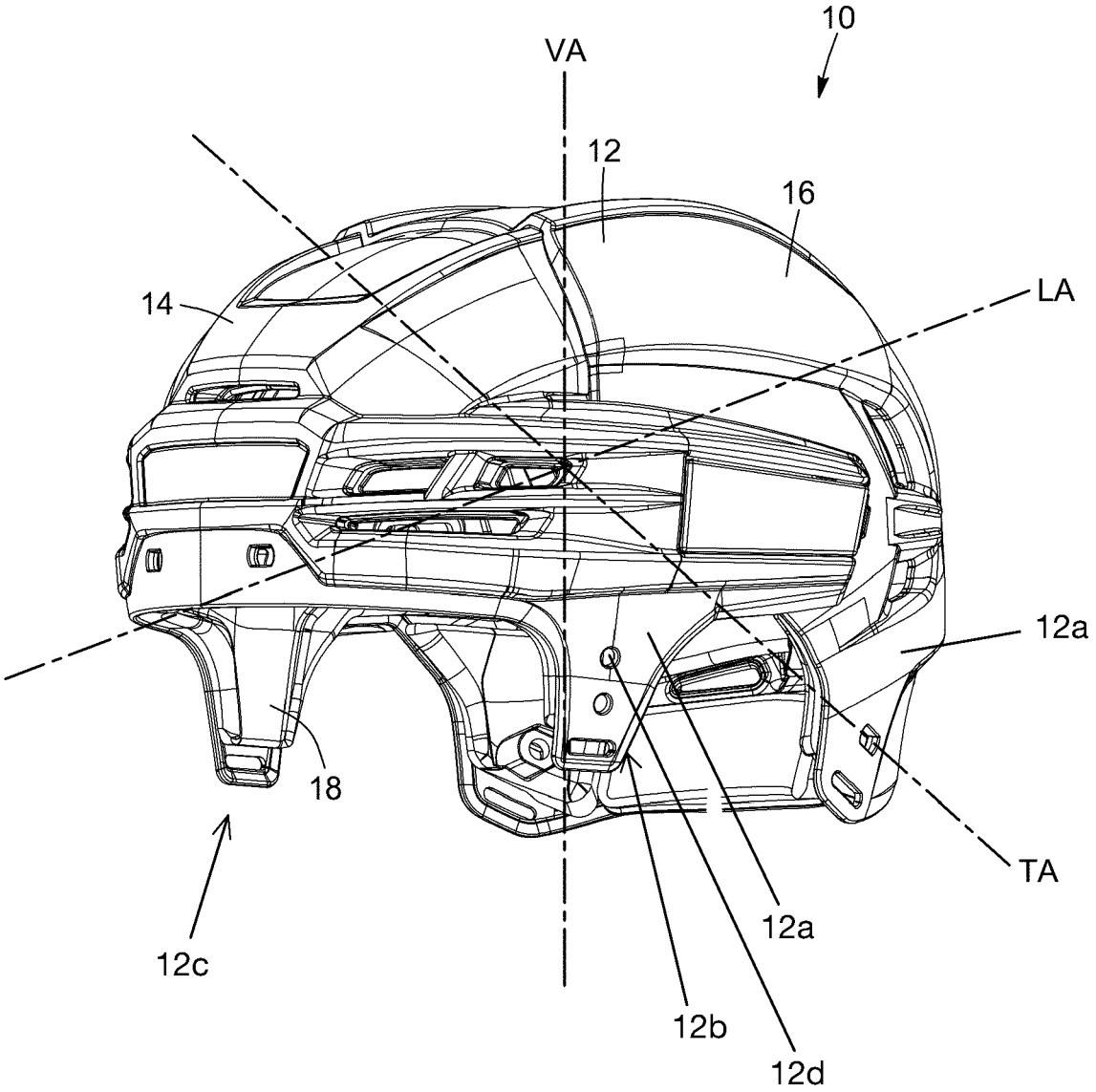
FIG. 3 is a schematic three dimensional view of a sports helmet for the head.

Referring to FIG. 3, a sport helmet in accordance with one embodiment is shown at 10. Variants, examples and preferred embodiments of the present disclosure are described hereinbelow. More particularly, the figures show a sport helmet 10 for protecting the wearer's head in accordance with an embodiment of the present disclosure. In this embodiment, the sport helmet 10 is a hockey helmet 10 for protecting the head of the wearer who is a hockey player. However, the present disclosure is not limited to any particular type of sport helmet 10. For example, a sport helmet 10 constructed using principles described herein in respect of the sport helmet 10 may be used for protecting the head of a player of another type of contact sport in which there are significant impact forces on the player due to player-to-player and/or player-to-object contact (lacrosse or football for instance). It is also understood that the sport helmet 10 may be for protecting the head of a wearer involved in a sport other than a contact sport (e.g., bicycling, motorcycle, skiing, snowboarding, horseback riding or another equestrian activity, etc.).

The sport helmet 10 defines a cavity for receiving the wearer's head to protect the head when the sport helmet 10 is impacted (e.g., when the sport helmet 10 hits a board, ice or other playing surface or is struck by a puck, ball, a lacrosse or hockey stick, or when the player is receiving a hit (e.g., body check) by another player and the head of the player is hit directly or indirectly).

The sport helmet 10 has a longitudinal axis LA, a transversal axis TA and a vertical axis VA that respectively define a front-back direction, a left-right direction and a vertical direction of the sport helmet 10. The longitudinal axis LA may be seen as an axis that resides within an imaginary longitudinal plan that bisects the helmet 10 and that defines left and right sides on each side of the plane.

The sport helmet 10 has an outer shell 12 comprising a first or front shell 14 and a second or rear shell 16 at least partially enclosing an inner padding 18. The first and second shells 14, 16 may be made of a relatively rigid material, such as polyethylene, NYLON, polycarbonate materials, thermoplastics, or thermosetting resins or any other suitable material. The outer shell 12 has an outer surface 12*a* defined by the first and second shells 14, 16. The sport helmet 10 may also comprise ear loops and a chinstrap for securing the sport helmet 10 to the wearer's head. The sport helmet 10 may further comprise ear protectors for protecting the left and right ears of the wearer.

The sport helmet 10 is herein an adjustable sport helmet 10 wherein the outer shell 12 and the inner padding 18 are adjustable to adjust the fit of the sport helmet 10 on the wearer's head. To that end, the first shell 14 and its inner padding are movable relative to the second shell 16 and its inner padding in a longitudinal direction defined by the longitudinal axis LA (FIG. 3) to adjust the fit of the sport helmet 10 on the wearer's head. It is understood that the expression "the first shell moves relative to the second shell" covers movements of the first and second shells in relation to each other wherein both shells are movable in relation to each other, wherein only the first shell is movable in relation to the second shell or wherein only the second shell is movable in relation to the first shell. Relative movement of the first and second shells for adjustment purposes may be along the longitudinal axis in the front-back direction of the sport helmet 10 such that the front-back internal dimension of the cavity of the sport helmet 10 is adjusted.

The sport helmet 10 may be equipped with a visor, which is generally transparent or translucent (e.g., tinted). The visor may be secured to a left temple region 12*b* and a right temple region 12*c* of the outer shell 12 of the helmet 10 as will be discussed below. The left temple region 12*b* and the right temple region 12*c*, which may also be referred to as the left flap and the right flap respectively, substantially cover the temples of the head of the wearer. Such a visor is securable to left and right sides of the outer shell 12 of the helmet 10. More specifically, each of the left temple region 12*b* and the right temple region 12*c* defines two apertures 12*d* sized to receive fasteners to secure the visor to the outer shell 12 of the helmet 10. It will be appreciated that each of the flaps 12*b*, 12*c* may have more or less than two apertures 12*d*.

The transparent visor is used to protect some or all of the face of the wearer when the helmet 10 is worn. The visor may be bought separately and secured to the outer shell 12 of the helmet 10 by a wearer. However, the visor is typically shaped such that the wearer has to bend the visor and bias the visor toward the outer shell 12 to secure the visor to the outer shell 12. Doing so might be frustrating as it may be challenging to hold the visor bent while, at the same time, having to insert screws or other fasteners in the holes 12*d* defined through the outer shell 12 of the helmet 10.

Figure 4:
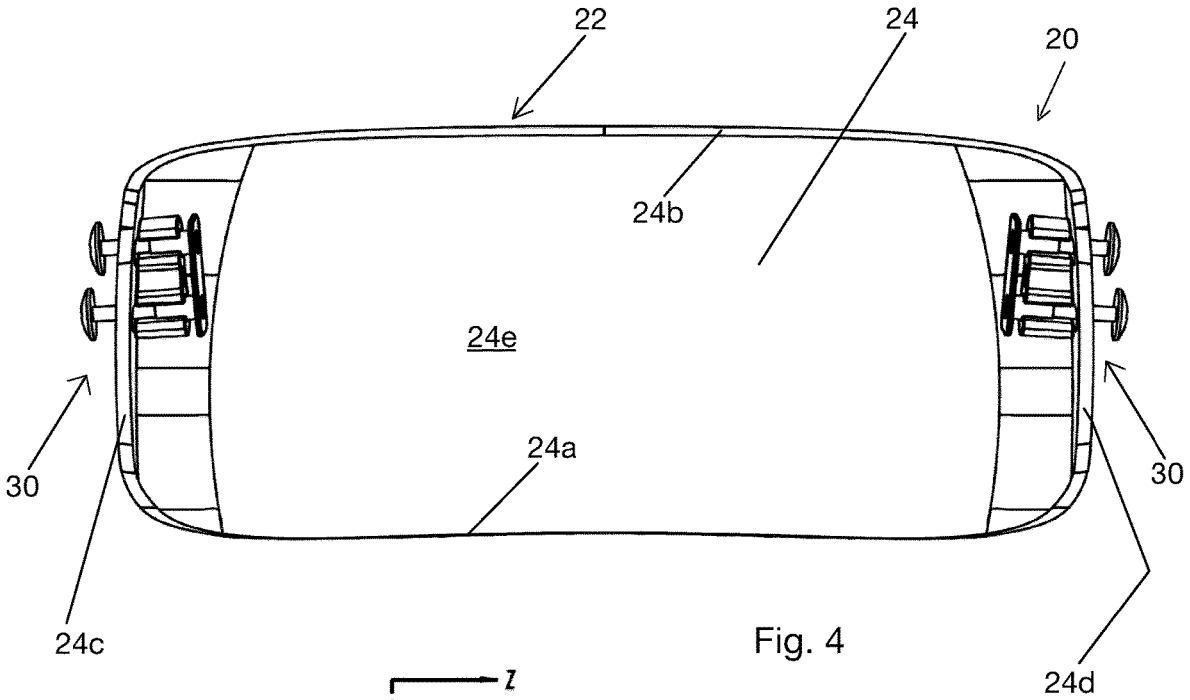
FIG. 4 is a rear view of a visor assembly for the helmet of FIG. 3 in accordance with one embodiment.
Figure 5:
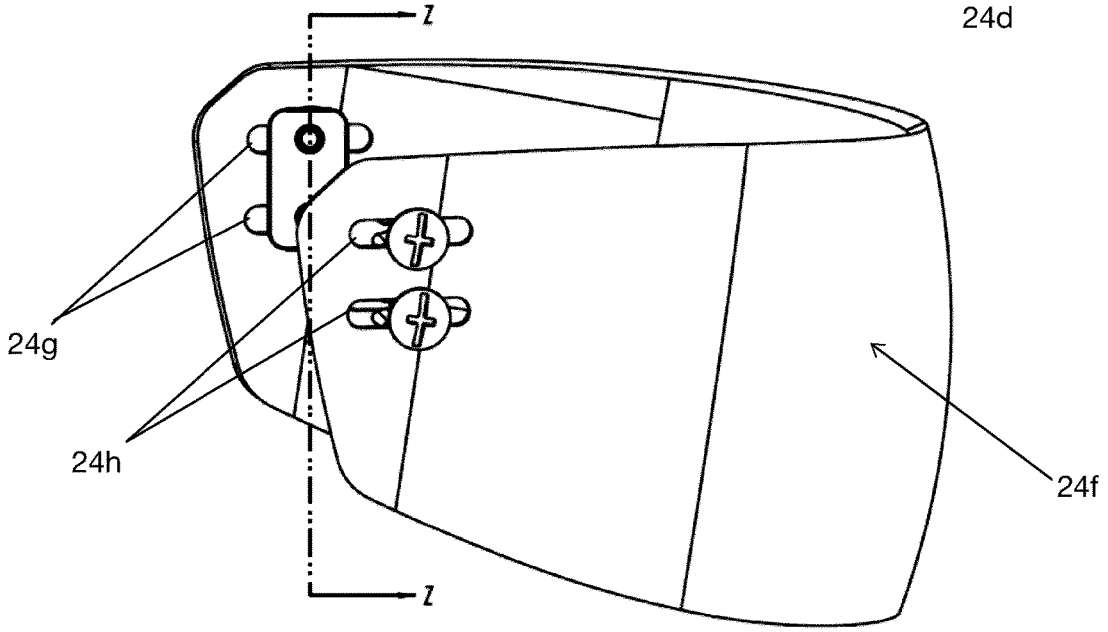
FIG. 5 is a side three dimensional view of the visor assembly of FIG. 4.

Referring now to FIGS. 4-5, a visor assembly in accordance with one embodiment is shown at 20. The visor assembly 20 includes a visor 22 and left and right attachment devices 30 to secure the visor 22 to the outer shell 12 of the helmet 10.

The visor 22 has a body 24 extending from a bottom edge 24*a* to a top edge 24*b* opposed the bottom edge 24*a* and extending from a left edge 24*c* to a right edge 24*d* opposed to the left edge 24*c*. Herein, the expression "left" and "right" are in relation to the wearer of the sports helmet 10. Each of the left edge 24*c* and the right edge 24*d* extends from the bottom edge 24*a* to the top edge 24*b*. When secured to the helmet 10, the top edge 24*b* lays above a front edge of the outer shell 12 and the bottom edge 24*a* is located proximate the nose N (FIG. 1) of the wearer. Each of the left edge 24*c* and the right edge 24*b* is locate adjacent a respective one of the left temple region 12*b* (FIG. 3) and the right temple region 12*c* (FIG. 3) of the outer shell 12 of the helmet 10. The body 24 of the visor 22 defines an inner surface 24*e* facing toward the wearer and an opposed outer surface 24*f* opposed the inner surface 24*e* and facing away from the wearer.

The visor 22 is a light-transmitting shield covering at least some of the face. In the embodiment shown, the visor 22 is adapted to substantially protect the top of the face as well as a part of the forehead of the wearer. When the helmet 10 is worn, the visor 22 thus extends from the lower forehead of the wearer to, or below, the nose, and rearwardly on the sides of the head to cover the temple and rear parts of the jaw. It will be appreciated that the visor 22 can take other configurations as well. For example, the visor 22 can cover the entire face of the wearer, or be smaller than the embodiment shown, for example covering only the eyes and region around the eyes of the wearer without covering the nose. The visor 22 can be made from any suitable type of polymer or glass material, for example capable of withstanding one (or more) impact from an object, such as a hockey puck or a ball. The visor 22 is typically a curved body contouring the face of the wearer. The visor 22 extends between two side end portions located at opposite extremities of the visor 22.

As shown more particularly on FIG. 5, the visor body defines a pair of left slots 24*g* and a pair of right slots 24*h*. In some embodiments, more or less than two left slots and more or less than two right slots may be defined by the visor body 24. In some embodiments, the slots may be round apertures. The slots of each pairs of the slots 24*g*, 24*h* are vertically offset relative to the vertical axis VA (FIG. 3). Each of the slots 24*g*, 24*h* is elongated in a longitudinal direction relative to the longitudinal axis LA (FIG. 3). The slots 24*g*, 24*h* allow the wearer to adjust a position of the visor 22 relative to the outer shell 12 of the helmet 10.

The left and right attachment devices 30 are described below. Since they are identical in the present embodiment, only one attachment device 30 will be described and referred to below as "the attachment device". It will be appreciated that the description below applies to both of the left and right attachment devices 30.

Figure 6:
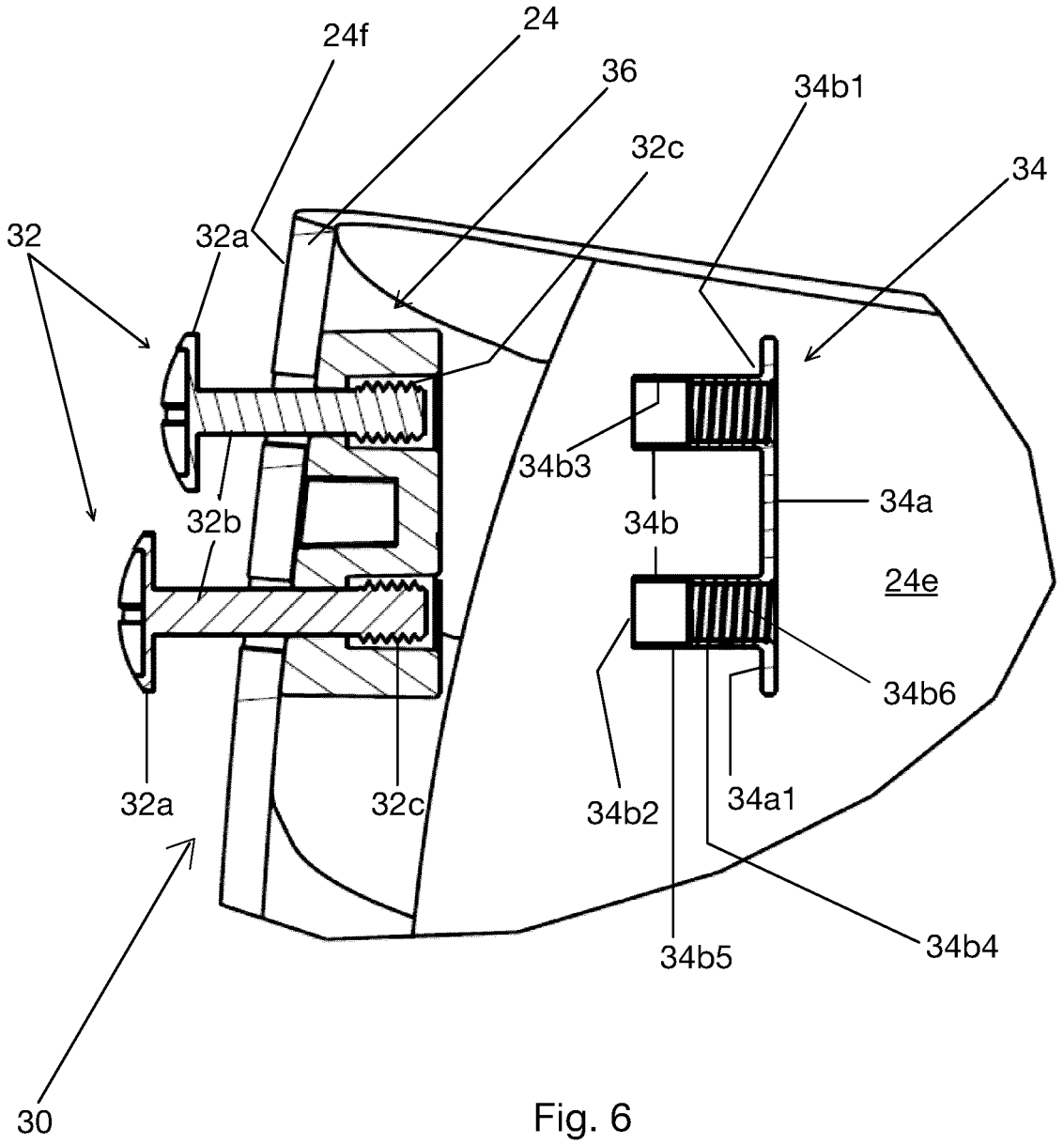
FIG. 6 is a cutaway, partially exploded, view of the visor assembly of FIGS. 4-5 taken along lines Z-Z in FIG. 5, illustrating an attachment device for securing a visor to the helmet of FIG. 3.
Figure 13A:
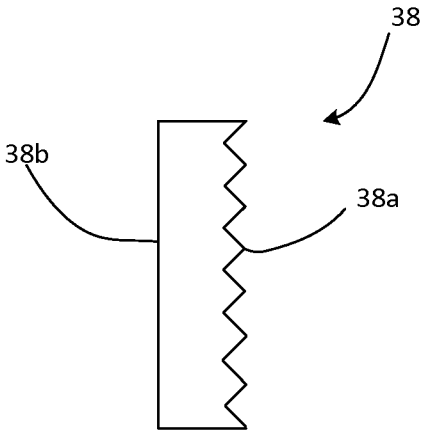
FIG. 13A is a schematic cross-sectional view of a washer in accordance with one embodiment.
Figure 13B:
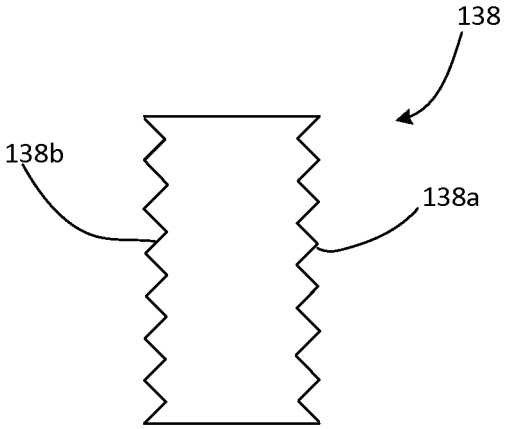
FIG. 13B is a schematic cross-sectional view of a washer in accordance with another embodiment.
Figure 13C:
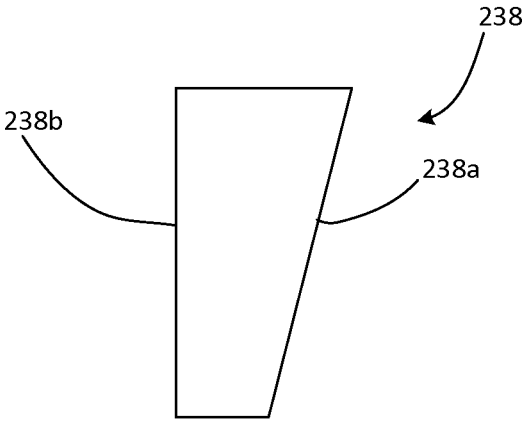
FIG. 13C is a schematic cross-sectional view of a washer in accordance with another embodiment.
Figure 14:
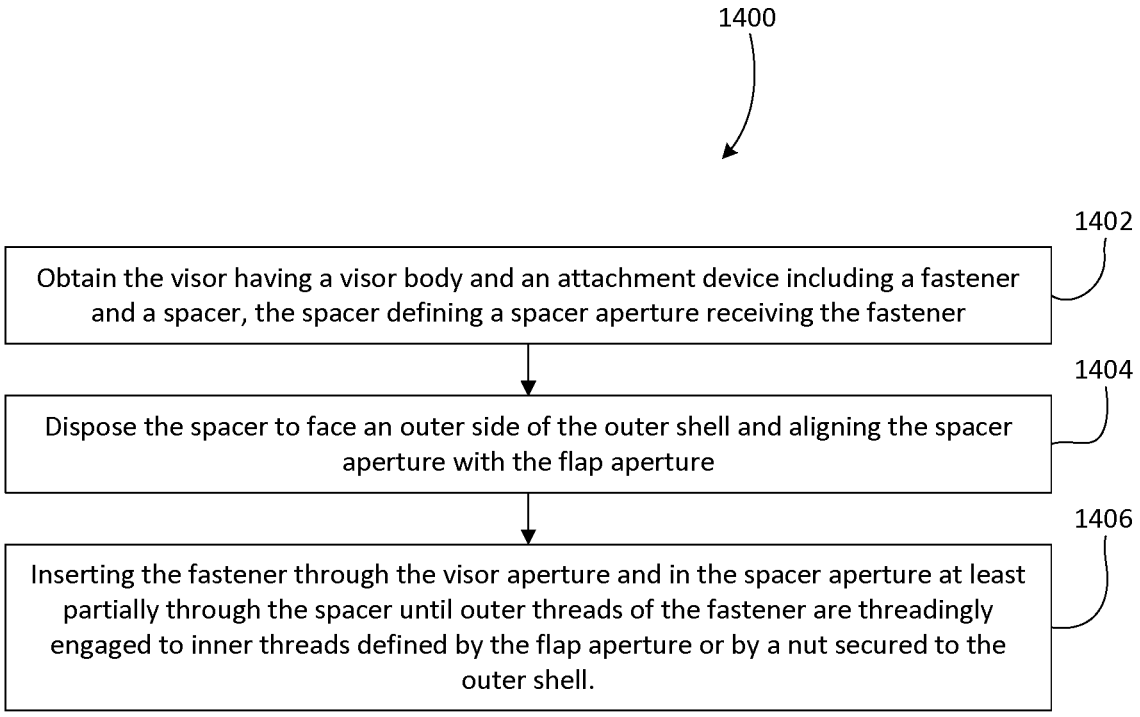
FIG. 14 is a flowchart illustrating steps of installing the visor of FIG. 4 to the helmet of FIG. 3.

Referring more particularly to FIG. 6, the attachment device 30 includes two fasteners 32, a double-nut 34, and a spacer 36. In some embodiments, more or less than two fasteners 32 may be used. In some embodiments, the double-nut 34 may be a single nut. Each of the fasteners 32 has a head 32*a* of a diameter greater than a height of the slots 24*g*, 24*h*. The heads 32*a* of the fasteners 32 are sized to abut against the outer surface 24*f* of the body 24 of the visor 22, or against a washer disposed between the fastener heads 32*a* and the outer surface 24*f* of the body 24. Washers 38, 138, 238 as depicted in FIGS. 13A-13C may, for example, be used in this regard. The washers 38, 138, 238 are not depicted in FIG. 6 or 9 for simplicity purposes, however it is to be understood that such washers will be present within the gaps shown in FIGS. 6 and 9 between the heads 32 of the fasteners 32 and the outer surface 24*f* of the body 24. Each of the fasteners 32 has a shank 32*b* protruding from the head 32*a* and defining outer threads 32*c*. It will be understood that a diameter of the outer threads 32*c* of the fasteners 32 may be suitably dimensioned to be able to be inserted through the slots 24*g*, 24*h*.

The double-nut 34 includes a base 34*a* and two posts 34*b*, although more or less than two posts 34*b* may be used, protruding from the base 34*a* from proximal ends 34*b*1 at the base 34*a* to distal ends 34*b*2 being spaced apart from the base 34*a*. The base 34*a* defines a base surface 34*a*1 configured to be in abutment against an inner surface 12*e* (FIG. 9) of the outer shell 12 of the helmet 10 when the visor 22 is secured to the helmet 10. Each of the two posts 34*b* defines an inner surface 34*b*3 having a first section 34*b*4 extending from the proximal end 34*b*1 toward the distal end 34*b*2 and a second section 34*b*5 extending from the first section 34*b*4 to the distal end 34*b*2. The first sections 34*b*4 define inner threads 34*b*6 whereas the second sections 34*b*5 may be free of threads. The inner threads 34*b*6 are threadingly engageable by the outer threads 32*c* of the fasteners 32.

It will be appreciated that the inner threads 34*b*6 may alternatively be defined by peripheral walls of the apertures 12*d* defined through the flaps 12*b*, 12*c* of the outer shell 12 of the helmet 10. The inner threads 34*b*6 may be defined by threaded inserts being secured (e.g., glued, locked, fastened, etc) to the flaps 12*b*, 12*c*. The inner threads 34*b*6 may be defined by a nut disposed on the inner side of the outer shell 12 and held in place while the fasteners 32 are being threaded therethrough.

An inner diameter of the second sections 34*b*5 may be greater than an outer diameter of the outer threads 32*c* of the fasteners 32 to allow a sliding engagement of the outer threads 32*c* of the shanks 32*b* of the fasteners 32 into the second sections 34*b*5 of the posts 34*b*. The inner threads 34*b*6 of the posts 34*b* are threadingly engageable by the outer threads 32*c* of the fasteners 32 to secure the visor 22 to the helmet 10 as will be explained further below. It will be appreciated that, alternatively, the double-nut 34 may be replaced by two separate nuts each having a base and a post protruding from the base. It will be understood that a diameter of the outer threads 32*c* of the fasteners 32 may be suitably dimensioned to be able to be inserted through the slots 24*g*, 24*h*. A height of the slots taken along the vertical axis VA may be greater than the diameter of the outer threads 32*c*.

Figure 7:
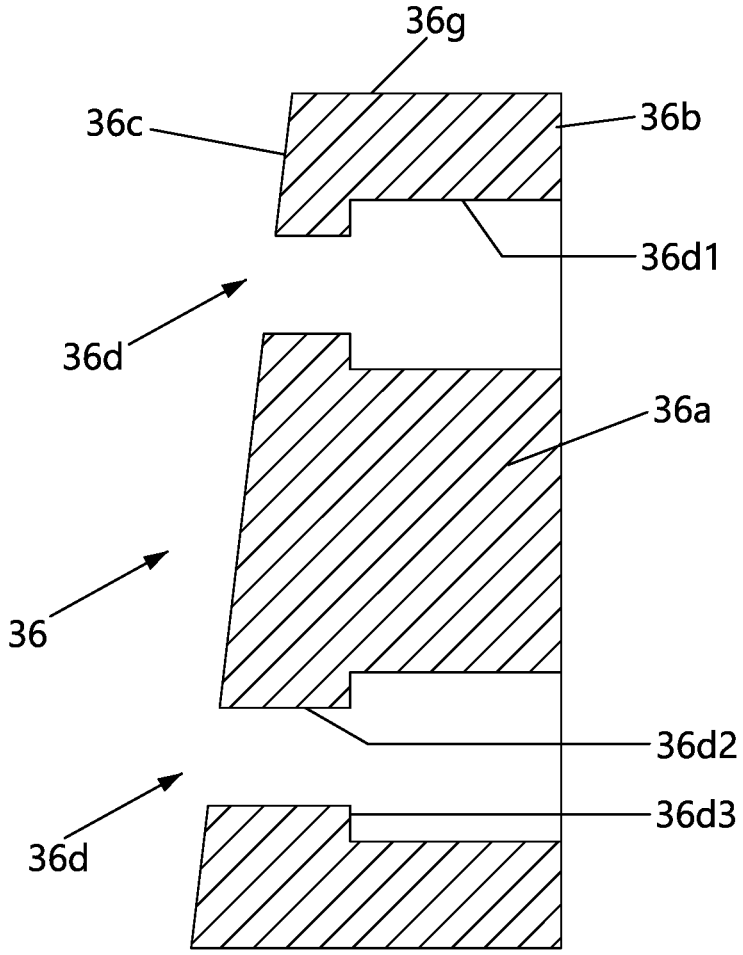
FIG. 7 is a cross-sectional view of a spacer for the attachment device of the visor assembly of FIG. 4.
Figure 8:
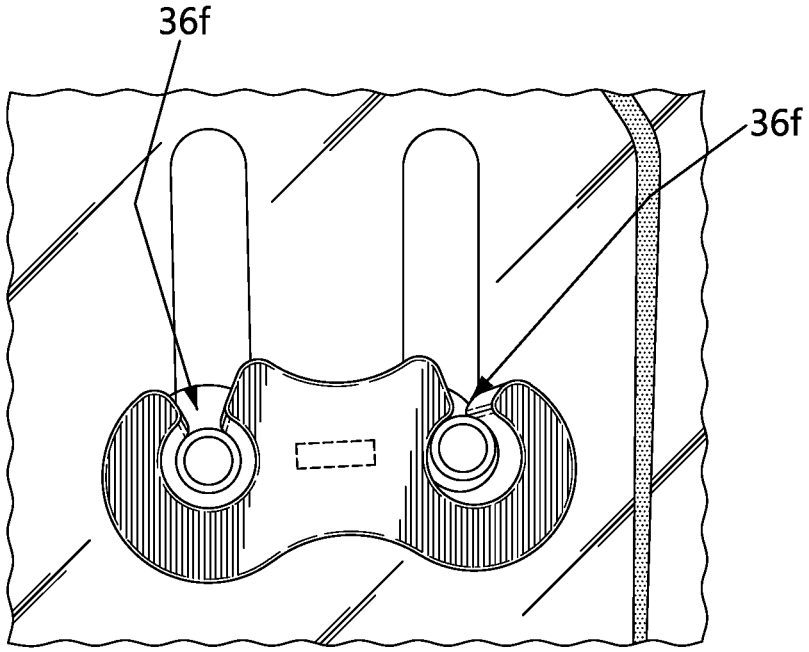
FIG. 8 is a front view of the spacer of FIG. 7.

Referring to FIGS. 7-8, the spacer 36 includes a spacer body 36*a* extending from a first face 36*b* that is oriented toward the double-nut 34 and that faces the outer side of the outer shell 12, and a second face 36*c* opposed the first face 36*b* and oriented toward the body 24 of the visor 22. The second face 36*c* is in the embodiment shown in abutment against the inner surface 24*e* of the body 24 of the visor 22. The first and second faces 36*b*, 36*c* may be non-parallel to one another such that each of the first and second faces 36*b*, 36*c* defines an abutment surface with a respective one of the visor 22 and the outer side of the outer shell 12 of the helmet 10. In some cases, the first and second faces 36*b*, 36*c* may be parallel to one another. The first and second faces 36*b*, 36*c* may have any suitable shape (e.g., curved) to match shapes of the visor body 24 and of the outer side of the shell 12. The spacer body 36*a* has a thickness extending from the first face 36*b* to the second face 36*c*. The thickness of the spacer 36 is selected to create a gap between the visor body 24 and the outer shell 12 of the helmet 10. Such a gap is used to allow an air flow between the visor body and the outer shell 12 to prevent fogging of the visor 22. The spacer body 36*a* is made here of an elastomeric material and may therefore damp impacts it may be subjected to when the wearer is playing a sports. Damping the impacts on the visor 22 may attenuate a magnitude of such impacts that is transmitted to the outer shell 12 of the helmet 10 and to the head of the wearer.

The spacer body 36*a* defines two apertures 36*d*, although more or less is contemplated, extending from the first face 36*b* to the second face 36*c*. The number of apertures 36*d* may correspond to a number of the fasteners 32. Each of the two apertures 36*d* is sized to receive a respective one of the two fasteners 32. Particularly, each of the two apertures 36*d* has a proximal section 36*d*1 and a distal section 36*d*2. The proximal section 36*d*1 extends from the first face 36*b* of the spacer body 36 toward the second face 36*c* and the distal section 36*d*2 extends from the proximal section 36*d*1 to the second face 36*c* of the spacer body 36*a*. A diameter of the distal section 36*d*2 is less than a diameter of the proximal section 36*d*1 to define a shoulder 36*d*3. The shoulder 36*d*3 is sized to abut against the outer threads 32*c* (FIG. 6) of the shanks 32*b* of the fasteners 32 and prevent the spacer 36 from becoming loose and from falling off during an installation of the visor 22 to the helmet 10. In other words, a diameter of the distal section 36*d*2 of the apertures 36*d* defined through the spacer 36 is less than an outer diameter of the outer threads 32*c* of the fasteners 32.

The diameter of the proximal sections 36*d*1 is sized to receive the posts 34*b* of the double-nut 34 therein. More specifically, the posts 34*b* of the double-nut 34 may be inserted through the apertures 12*d* defined by the flaps 12*b*, 12*c* from the inner side of the outer shell 12 to the outer side thereof until they protrude beyond the outer side of the outer shell 12. The posts 34*b* (FIG. 6) are received within the proximal sections 36*d*1 of the apertures 36*d* of the spacer body 36 when the visor 22 is not secured to the helmet 10. Stated differently, the outer diameter of the second sections 34*b*5 of the posts 34*b* is smaller than the inner diameter of the proximal section 36*d*1 of the apertures 36*d* to allow a sliding engagement of the double-nut 34 into the spacer 36. As such, all of the necessary pieces may be secured to one another preventing the wearer from losing some of the pieces. In an alternate embodiment, a frictional engagement may be defined between the posts 34*b* and the spacer 36. Such a frictional engagement is however not required.

Referring more particularly to FIG. 8, the spacer body 36 may define two openings 36*f* extending each from a peripheral surface 36*g* (FIG. 7) of the spacer body 36*a* to a respective one of the two apertures 36*d*. These openings 36*f* allow a user to increase a dimension of the two apertures 36*d* by deforming the spacer body 36*a*, which may be made of a compliant material, such as an elastomeric material. The openings 36*f* defined through the spacer body 36*a*, in combination with a flexibility of a material of the spacer body 36, may allow a user to install and uninstall the spacer 36 over the fasteners 32, more specifically, over the shank 32*b* of the fasteners 32 without having to disengage the fasteners 32 from the double-nut 34. In an undeformed state of the spacer, a width of the openings 36*f* is less than a diameter of the apertures 36*d* defined through the spacer 36 and less than a diameter of the shanks 32*b* of the fasteners 32.

Figure 9:
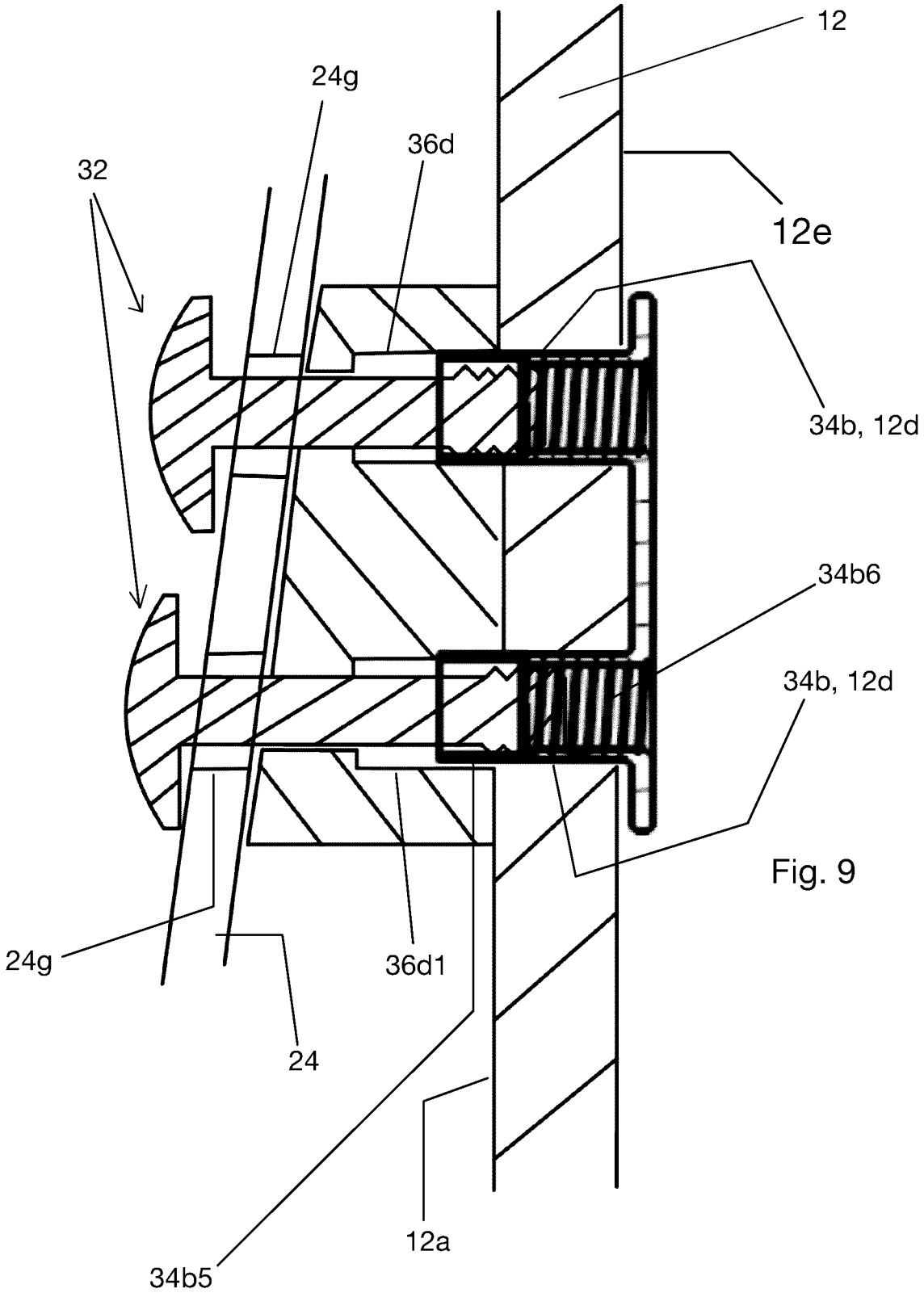
FIG. 9 is a schematic cutaway view showing the visor assembly of FIG. 4 secured to an outer shell 12 of the helmet of FIG. 3.

Referring now to FIG. 9, the attachment device 30 is shown secured to the outer shell 12 of the helmet 10. As illustrated, the posts 34*b* of the double-nut 34 are received within the apertures 12*d* defined through the outer shell 12 and are partially received within the apertures 36*d* of the spacers 36. Particularly, a portion of the posts 34*b* is received within the proximal sections 36*d*1 of the apertures 36*d* defined through the spacer body 36*a*. The fasteners 32 are inserted through the slots 24*g*, 24*h* defined through the body 24 of the visor 22, through the apertures 36*d* of the spacer body 36*a* until the outer threads 32*c* threadingly engage the inner threads 34*b*6 of the posts 34*b*. At which point, the fasteners 32 may be tightened to securely attach the visor body 24 to the helmet 10. It will be appreciated that, alternatively, the posts 34 may be flush with the outer surface 12*a* of the shell 12 such that there is no engagement between the spacer body 36 and the posts 34*b* of the double-nut 34 when the visor 22 is attached to the helmet 10. A frictional engagement may or may not be present between the spacer 36 and the posts 34*b*.

As illustrated in FIG. 9, the visor 22 may be angled relative to the heads of the fasteners. This angle may provide an uneven pressure distribution between the fasteners 32 and the visor 22 and may result in movements of the visor 22 relative to the fasteners 32 during tightening. Washers may be used to cater to this angle, and to provide a more even pressure distribution between the heads of the fasteners 32 and the visor 22. Washers 38, 138, 238 as depicted in FIGS. 13A-13C and described further below, may for example be used. In some cases, a thickness of the body 24 of the visor 22 may be varied to cater to this angle between the heads 32*a* and the body 24 of the visor 22.

Referring to FIGS. 13A, a washer 38 may be disposed between the head 32*a* of the fastener 32 and the visor 22. The washer 38 may have a first face 38*a* facing the visor 22 and a second face 38*b* facing the head 32*a* of the fastener 32. The first face 38*a* may be serrated to provide a frictional engagement with the visor 32 to limit rotation of the washer 38 relative to the visor 22 when the fastener 32 is being threaded into the double-nut 34. The second face 38*b* of the washer 38 may be smooth, that is having a surface roughness less than that of the first face 38*a*, to allow the head 32*a* of the fastener 32 to rotate relative to the washer 38.

Referring to FIGS. 13B, a washer 138 in accordance with another embodiment may be disposed between the head 32*a* of the fastener 32 and the visor 22. The washer 138 may have a first face 138*a* facing the visor 22 and a second face 138*b* facing the head 32*a* of the fastener 32. The first and second faces 138*a*, 138*b* may be serrated to provide a frictional engagement with the visor 32 and with the head 32*a* of the fastener. Alternatively, both sides 138*a*, 138*b* of the washer 138 may be smooth, that is, non-serrated.

Referring to FIG. 13C, a washer 238 in accordance with another embodiment may be disposed between the head 32*a* of the fastener 32 and the visor 22. The washer 238 may have a first face 238*a* facing the visor 22 and a second face 238*b* facing the head 32*a* of the fastener 32. The washer 238 may be a beveled washer. That is, the first face 238*a* may be angled (e.g., non-parallel) to the second face 238*b* such that the first face 238*a* is substantially parallel to the visor 22 to provide an area of pressure distribution between the washer 238 and the visor 22. The second face 238*b* may be parallel to the head 32*a* of the fastener 32. Either one of the first and second faces 238*a*, 238*b* may be serrated.

A washer including any combination of the features described above (e.g., bevel, serrated face(s)) may be used without departing from the scope of the present disclosure.

All the parts of the visor 22 assembly 20 having been described, a method of assembly the visor body to the helmet 10 are now described with reference to FIGS. 10 to 12, and 14 with continued reference to FIGS. 1-9.

The method 1400 includes obtaining the visor 22 and the attachment device 30 including the fastener 32 and a spacer 36 at 1402; disposing the spacer 36 to face the outer side of the outer shell 12 and aligning the aperture 36*d* of the spacer 36 with the aperture 12*d* defined through the flap 12*b*, 12*c* at 1404; and inserting the fastener 32 through the aperture 24*g* (e.g., slot) defined through the visor body 24 and in the aperture 36*d* of the spacer 36 at least partially through the spacer 36 until the outer threads 32*c* of the fastener 32 are threadingly engaged to the inner threads 34*b*6 defined by one or both of the aperture 12*d* of the flap 12*b*, 12*c* and a nut (e.g., double-nut 34) secured to the outer shell 12 at 1406.

In the embodiment shown, the method includes inserting the fastener 32 through the aperture (e.g., slot 24*g*) defined through the visor body 24 and through the distal section 36*d*2 of the aperture 36*d* of the spacer 36 until the outer threads 32*c* are received within the proximal section 36*d*1 of the aperture 36*d* of the spacer 36. The method 1400 may include inserting the post 34*b* through the aperture 12 of the flap 12*b*, 12*c* until the base 34*a* is abutted against the inner side of the outer shell 12. The method 1400 may include slidingly inserting the outer threads 32*c* of the fastener 32 into the second section 34*b*5 of the post 34*b* until the outer threads 32*c* reaches the inner threads 34*b*6 and threadingly engaging the outer threads 32*c* to the inner threads 34*b*6. The method 1400 may include slidingly inserting the outer threads 32*c* of the fastener 32 into the second section 34*b*5 of the post 34*b* until the outer threads 32*c* reaches the inner threads 34*b*6 and threadingly engaging the outer threads 32*c* to the inner threads 34*b*6. The method 1400 may include inserting the post 34*b* through the aperture 12*d* through the flap 12*c*, 12*d* until the post 34*b* protrudes beyond the outer side of the outer shell 12. The method 1400 may include inserting a portion of the post 34*b* that protrudes beyond the outer shell 12 partially through the aperture 36*d* of the spacer 36.

Figure 10:
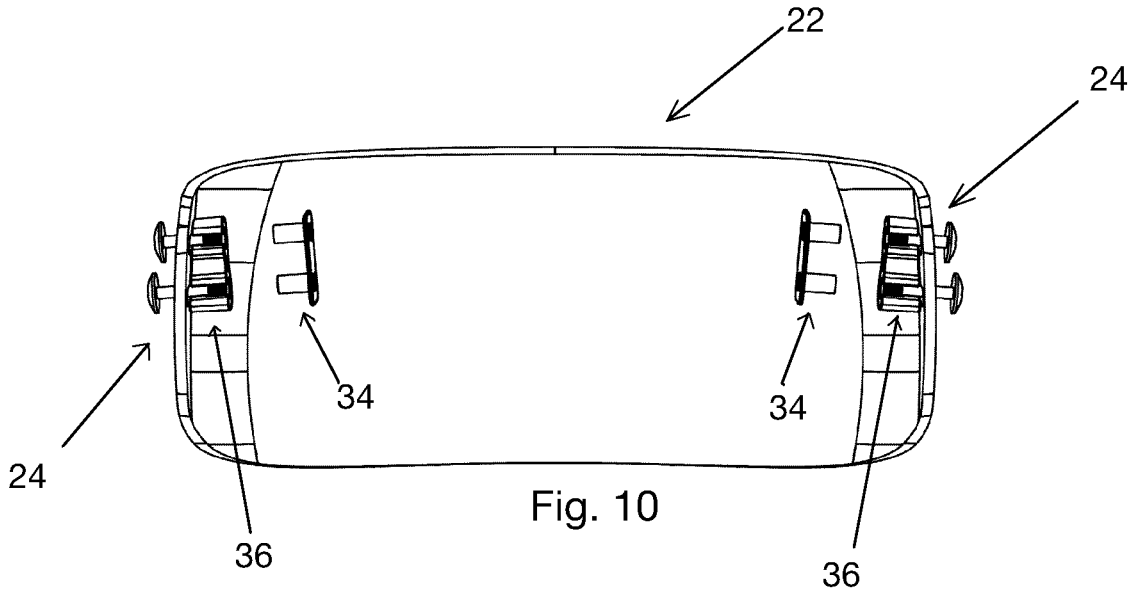
FIG. 10 is a rear partially exploded view of the visor assembly of FIG. 4.
Figure 11:
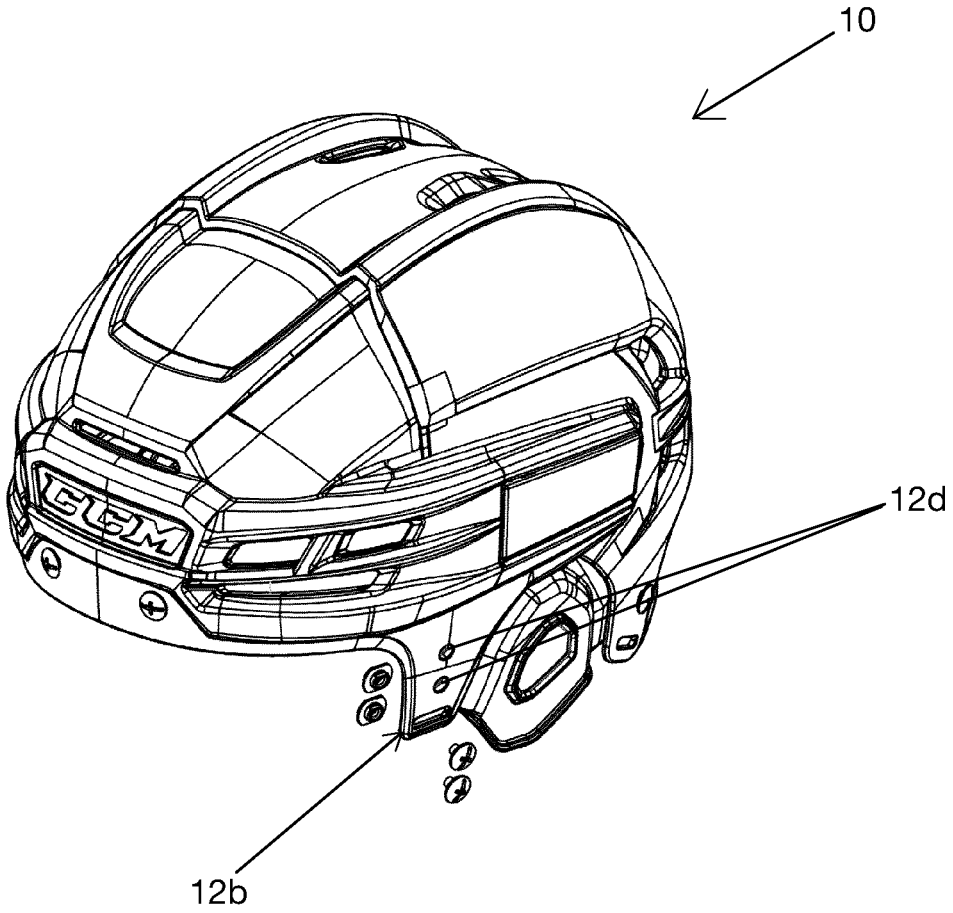
FIG. 11 is a three dimensional partially exploded view of the helmet of FIG. 3.
Figure 12:
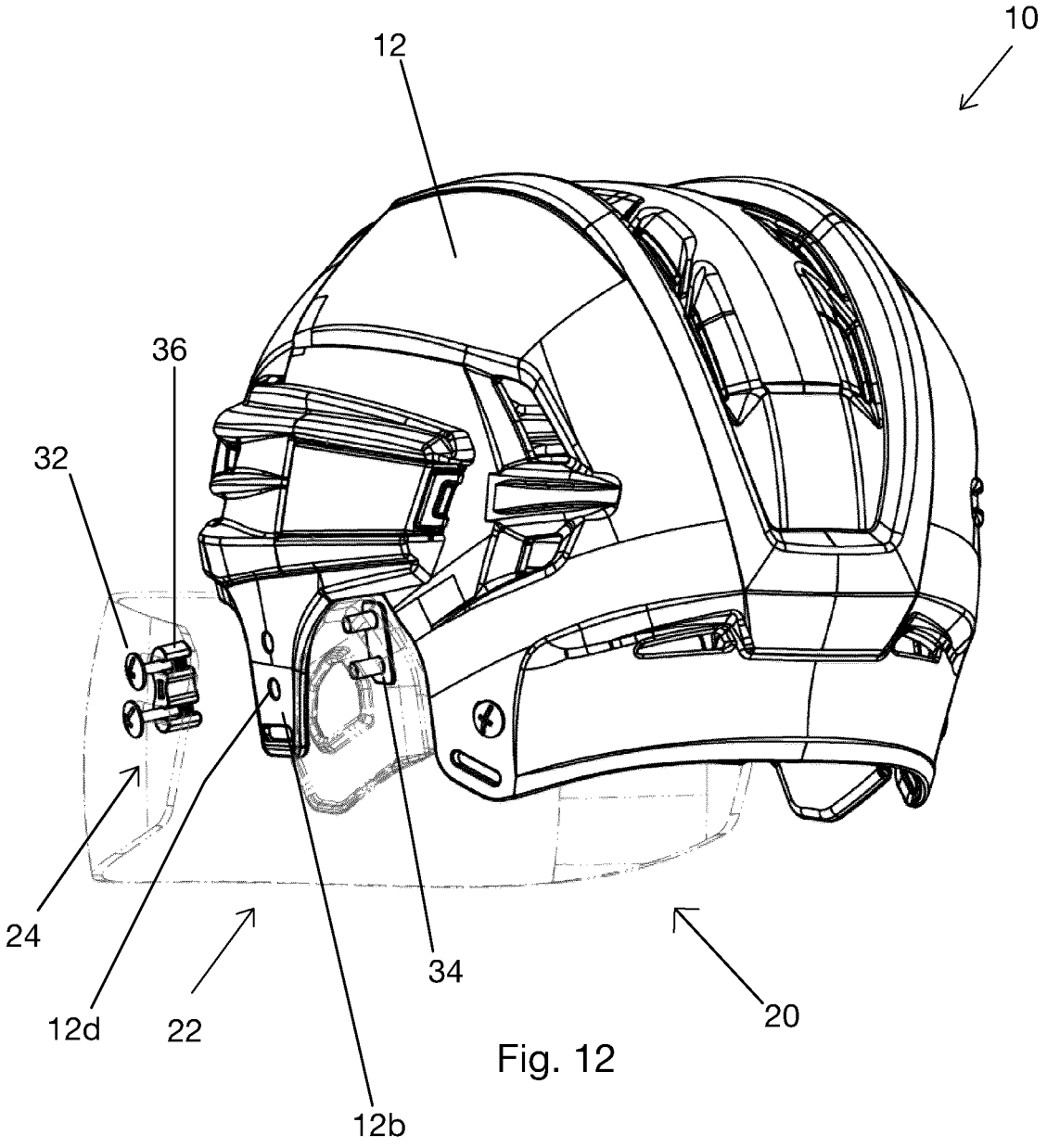
FIG. 12 is a rear three dimensional exploded view of the helmet of FIG. 3 and the visor assembly of FIG. 4.

The wearer may first separate the double-nut 34 from the spacer body 36 as illustrated in FIG. 10. The wearer may then remove existing fasteners that are secured to the flaps 12*b*, 12*c* of the helmet 10 as shown in FIG. 11. As shown in FIG. 12, the wearer may then insert the posts 34*b* of the double-nut 34 into the apertures 12*d* defined through the outer shell 12 from the inner side 12*e* of the outer shell 12 to the outer side 12*a* thereof. The posts 34*b* may be inserted into to the apertures 12*d* defined through the flaps 12*b*, 12*c* of the outer shell 12 of the helmet 10. The posts 34*b* may be loose within the apertures 12*d* of the outer shell 12 or may be frictionally engaged thereto. The wearer may then position the visor body 24, which is sandwiched between the heads 32*a* of the fasteners 32 and the spacer body 36, until the shanks 32*b* of the fasteners 32 are in register with the apertures 12*d* defined though the outer shell 12 of the helmet 10 and in register with the posts 34*b* of the double-nut 34. The wearer may then start fastening the fasteners 32 until the outer threads 32*c* of the shanks 32*b* of the fasteners 32*b* are threadingly engaged to the inner threads 34*b*6 of the posts 34*b*. The wearer may then tighten the fasteners 32 to securely attach the visor body 24 to the helmet 10 as illustrated in FIG. 9.

As shown in FIG. 9, at least a portion of the second sections 34*b*5 of the posts 34*b* protrude beyond the outer surface 12*a* of the outer shell 12. This may facilitate the step of registering the fasteners 32 with the posts 34*b*. Moreover, having the second sections 34*b*5 of the posts 34*b* free of threads may allow the wearer to inert the fasteners 32 into both of the posts 34*b* without having to engage their respective threads. The installing process may thus be simplified since the fasteners 32 are constrained in movement in a radial direction relative to their longitudinal axis thanks to the posts 34*b*.

The process of installing the visor 22 may be simplified because the wearer may not need to frictionally engage the spacer 36 to the posts 34*b* before inserting the fasteners 32 through the apertures 24*g*, 24*h* of the visor body 24 and through the apertures 36*d* defined through the spacer body 36*a*. This is at least partially enabled by the different diameters of the sections 36*d*1, 36*d*2 of the apertures 36*d* through the spacer body 36*a* allowing to maintain the fasteners 32 engaged to the spacer body 36*a*. In the embodiment shown, once the double-nut 34 is disengaged from the spacer body 36, two separate items are to be handled by the user during assembly, namely, the spacer 36 secured to the visor 22 via the fasteners 32, and the double-nut 34. This may result in the user having to handle solely the double-nut 34 as opposed of having the user handling the two fasteners 32. It may be more cumbersome to handle two fasteners 32, which may be small pieces, than to handle the double-nut 34.

Moreover, in the present embodiment, a frictional engagement of the spacer 36 to the posts 34*b* of the double nut 34 is not required. This may allow a connection between the spacer 36 and the two fasteners 32 to occur before the visor 22 is installed to the helmet 10. In fact, the visor 22 may be sold with the spacer 36 and the fasteners 32 already connected to the visor 22. This may remove any risk of installing the spacer 36 incorrectly. Indeed, since the spacer 36 is already properly mounted to the visor via the fasteners 32, there may be no risk of incorrectly installing the spacer 36. The user may simply remove the double-nut 34 and sandwich the temple regions 12*b*, 12*c* of the helmet 10 between the spacer 36 and the double-nut 34 as explained herein above without having to handle the fasteners 32.

It will be appreciated that, in an alternate embodiment, the double-nut 34 may be a single-nut defining solely one post 34*b*. In another alternate embodiment, the double-nut 34 may include two individual single-nut each defining a respective post 34*b*. The spacer 36 defining two apertures 36*d* may be replaced by two spacers each defining a respective aperture 34*d*. In some embodiments, only one spacer defining a single aperture may be used.

It will be appreciated that, in an alternate embodiment, the fastener 32 may define inner threads and the posts 34 may define outer threads without departing from the scope of the present disclosure.

As can be seen therefore, the examples described above and illustrated are intended to be exemplary only. The disclosed attachment devices 30 may be used for any face protectors that require a spacer in their attachment configuration. The scope is indicated by the appended claims.

What is claimed is:

1. A visor securable to a sport helmet, the sport helmet having an outer shell defining flaps covering temples of head of a wearer, the visor comprising:

a visor body defining a visor aperture through the visor body on a side of the visor body; and an attachment device on the side of the visor body configured to secure the visor to a corresponding one of the flaps of the outer shell of the sport helmet, the attachment device having:

a fastener extending through the visor aperture, the fastener having a head facing an outer side of the visor body, the fastener defining first threads threadingly engageable to second threads configured to be defined by one or both of the corresponding one of the flaps and a nut configured to be secured to the outer shell, and a spacer having a first face for facing the outer shell and a second face configured to be oriented toward the visor, the spacer facing an inner side of the visor body, the spacer defining a spacer aperture in register with the visor aperture, the fastener extending in the spacer aperture at least partially through the spacer, the spacer aperture extending from the first face to the second face, the spacer aperture having a first section extending from the first face toward the second face and a second section extending from the first section to the second face, a diameter of the first section of the spacer aperture greater than a diameter of the second section, the nut, the nut having a base configured to be abuttable against an inner side of the outer shell and a post protruding from the base, the post defining the second threads threadingly engaged by the first threads of the fastener, the post sized to be receivable within a flap aperture defined by the corresponding one of the flaps, wherein an inner surface of the post defines a proximal section extending from the base and a distal section extending from the proximal section to a distal end of the post, the second threads defined by the proximal section and the distal section being free of the second threads.

2. The visor of claim 1, wherein the diameter of the second section is less than a diameter of the first threads of the fastener.

3. The visor of claim 1, wherein the spacer defines an opening extending from a peripheral face of the spacer to the spacer aperture.

4. The visor of claim 3, wherein a width of the opening is less than a diameter of a shank of the fastener.

5. The visor of claim 1, wherein the post includes two posts each protruding from the base and wherein the fastener includes two fasteners, each of the two posts defining second threads matingly engageable to the first threads of the two fasteners.

6. The visor of claim 1, wherein an outer diameter of the first threads of the fastener is less than an inner diameter of the distal section of the post such that the fastener is slidably receivable within the distal section of the post.

7. The visor of claim 1, comprising a washer between the head of the fastener and the visor, the washer being beveled and/or serrated on one or both of opposed faces of the washer.

8. An attachment device for securing a visor body to an outer shell of a sport helmet, the visor body defining a visor aperture, the attachment device comprising:

a fastener sized and configured to extend through the visor aperture, the fastener having a head configured for facing an outer side of the visor body, the fastener defining first threads threadingly engageable to second threads defined by one or both of a flap of the outer shell of the helmet and a nut configured to be secured to the outer shell, and a spacer having a first face configured for facing the outer shell and a second face configured to be oriented toward the visor body, the spacer configured for facing an inner side of the visor body and sized to be received between the visor body and the flap, the spacer defining a spacer aperture, the fastener extending in the spacer aperture at least partially through the spacer, the spacer aperture extending from the first face to the second face, the spacer aperture having a first section extending from the first face toward the second face and a second section extending from the first section to the second face, a diameter of the first section greater than a diameter of the second section of the spacer aperture, the nut, the nut having a base configured to be abuttable against an inner side of the outer shell and a post protruding from the base, the post defining the second threads threadingly engaged by the first threads of the fastener, the post sized to be receivable within a flap aperture defined by the flap, wherein an inner surface of the post defines a proximal section extending from the base and a distal section extending from the proximal section to a distal end of the post, the second threads defined by the proximal section and the distal section being free of the second threads.

9. The attachment device of claim 8, wherein the diameter of the second section is less than a diameter of the first threads of the fastener.

10. The attachment device of claim 8, wherein the spacer defines an opening extending from a peripheral face of the spacer to the spacer aperture.

11. The attachment device of claim 8, wherein the post includes two posts each protruding from the base and wherein the fastener includes two fasteners, each of the two posts defining second threads matingly engageable to the first threads of the two fasteners.

12. The attachment device of claim 8, wherein an outer diameter of the first threads of the fastener is less than an inner diameter of the distal section of the inner surface of the post such that the fastener is slidably receivable within the distal section of the post.

13. The attachment device of claim 8, comprising a washer positionable between the head of the fastener and the visor body, the washer being beveled and/or serrated on one or both of opposed faces of the washer.

* * * * *